US005878515A

United States Patent [19]

Yang

[11] Patent Number: 5,878,515

[45] Date of Patent: Mar. 9, 1999

[54] DRIVING MECHANISM OF MUSIC WATER BALL

[75] Inventor: Shin-Ya Yang, Hsin Tien, Taiwan

[73] Assignee: Ya Yung Enterprise Co., Ltd., Taipei Hsien, Taiwan

[21] Appl. No.: 908,476

[22] Filed: Aug. 6, 1997

[51] Int. Cl.[6] ..... G09F 19/00

[52] U.S. Cl. ..... 40/409; 40/410

[58] Field of Search ..... 40/406, 409, 430, 40/433, 410; 277/439, 647, 649

[56] References Cited

U.S. PATENT DOCUMENTS

| | | | |
|---|---|---|---|
| 2,815,995 | 12/1957 | Young | 277/439 |
| 3,415,170 | 12/1968 | Smith | 277/439 X |
| 4,116,452 | 9/1978 | Schanz | 277/439 |
| 4,490,931 | 1/1985 | Fleemin | 40/406 |
| 5,018,288 | 5/1991 | Yang | 40/406 |
| 5,131,175 | 7/1992 | Liu | 40/406 X |
| 5,743,780 | 4/1998 | Liu | 40/406 X |

*Primary Examiner*—Joanne Silbermann
*Attorney, Agent, or Firm*—Pro-Techtor International Services

[57] ABSTRACT

A driving mechanism for a musical water ball provides a waterproof effect and enables the decoration of the water ball to rotate more smoothly and accurately. The driving mechanism includes a seat member, a silicone gasket, a central shaft rod, a fastening plate, a spring and a driven perforated disc. The silicone gasket is disposed in an inner hole seat of the seat member. The silicone gasket is formed with inner and outer rings that define an annular groove. When water flows into the annular groove, a fastening pressure is formed to bind the gasket to the central shaft rod. Water is thus prevented from infiltrating back so as to avoid rusting of the driving mechanism. Each of upper and lower ends of the shaft rod is formed with engaging teeth for engaging with a corresponding structure of the rotary tray and a corresponding structure of the central hole of the driven perforated disc. A spring is fitted around the shaft rod to abut against the fastening plate to provide a buffering effect.

2 Claims, 3 Drawing Sheets

DRIVING MECHANISM OF MUSIC WATER BALL

BACKGROUND OF THE INVENTION

The present invention relates to a driving mechanism of music water ball, which provides waterproof effect for avoiding rusting of the mechanism and enables the decoration of the water ball to rotate more smoothly and accurately.

The conventional music water ball includes a driving mechanism for rotating a decoration placed in the water ball in accordance with the music emitted from a music bell. A shaft rod is passed through a shaft hole of a rotary tray of a base of the decoration. A clearance exists between the shaft rod and the shaft hole. Therefore, after a period of use, the water in the water ball tends to infiltrate back through the clearance into the driving mechanism. This will lead to rusting of the driving mechanism and affect the operation thereof. Moreover, in the conventional water ball, the power of the winding spring of the music bell is transmitted through the shaft rod to the base for rotating the same. The power is directly transmitted via the shaft rod in a fastened state. When driving the decoration to rotate, the power is transmitted without any buffering, so that a frictional force takes place to make the rotation unsmooth and inaccurate.

SUMMARY OF THE INVENTION

It is therefore a primary object of the present invention to provide a driving mechanism of music water ball, which provides waterproof effect for avoiding rusting of the mechanism and enables the decoration of the water ball to rotate more smoothly and accurately.

According to the above object, the driving mechanism of music water ball of the present invention includes a seat member, a silicone gasket, a central shaft rod, a fastening plate, a spring and a driven perforated disc. The silicone gasket is disposed in an inner hole seat of the seat member. The silicone gasket is formed with inner and outer rings. When the gasket is assembled with the inner hole seat with the shaft rod passing therethrough, in the case that the water infiltrates back, the water will accumulate in an annular groove defined by the inner and outer rings to create a fastening pressure for forcing the gasket toward the central shaft rod and binding the same. Therefore, the water is prevented from infiltrating back so as to avoid rusting of the driving mechanism.

Each of upper and lower ends of the shaft rod is formed with engaging teeth for respectively engagaing with a corresponding structure of the rotary tray and a corresponding structure of the central hole of the driven perforated disc. A coil spring is fitted around the shaft rod to abut against the fastening plate for providing a buffering effect.

The present invention can be best understood through the following description and accompanying drawings, wherein:

DETAILED DESCRIPTION OF THE PREFERRED EMBODIMENT

Figure 1:
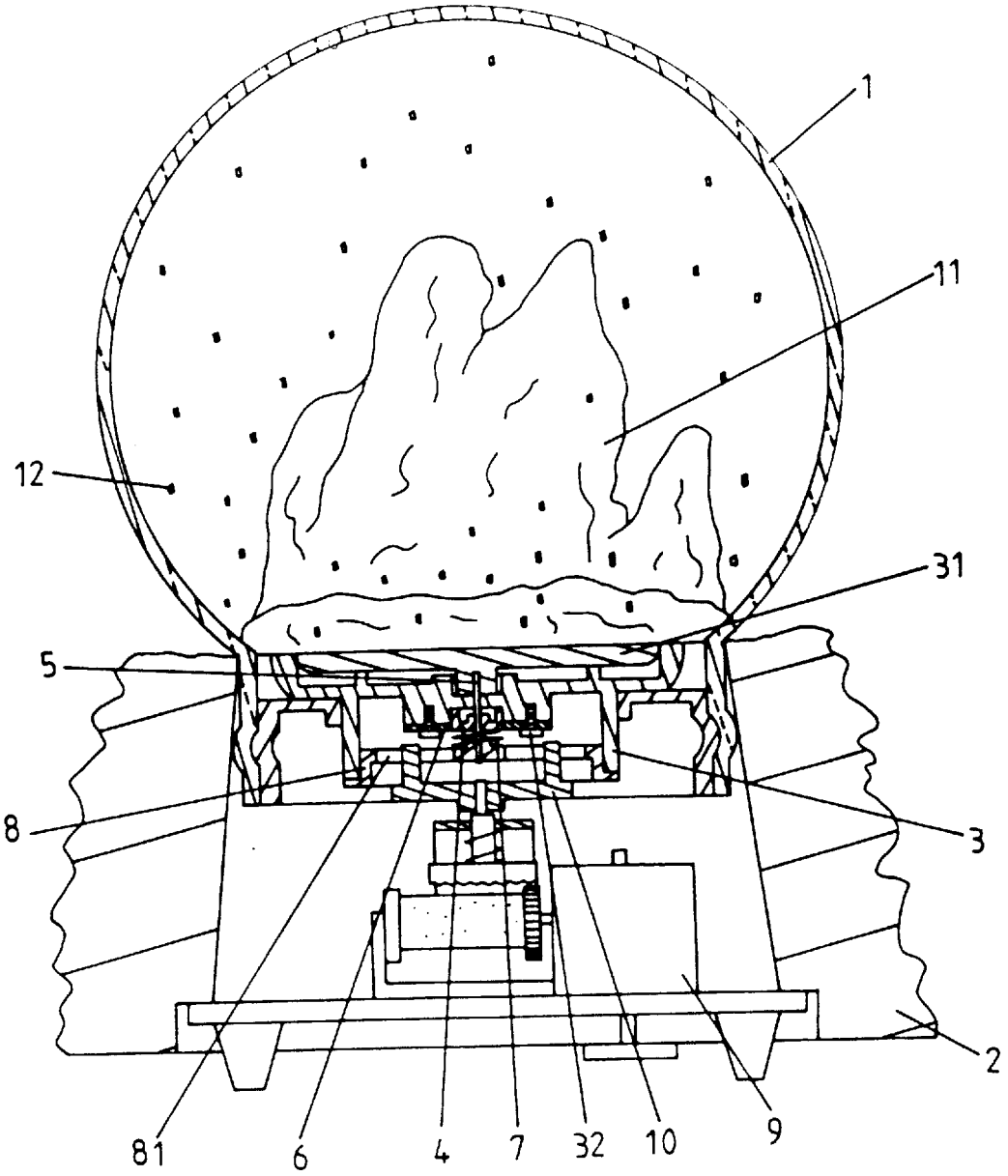
FIG. 1 is a sectional assembled view of the present invention.
Figure 2:
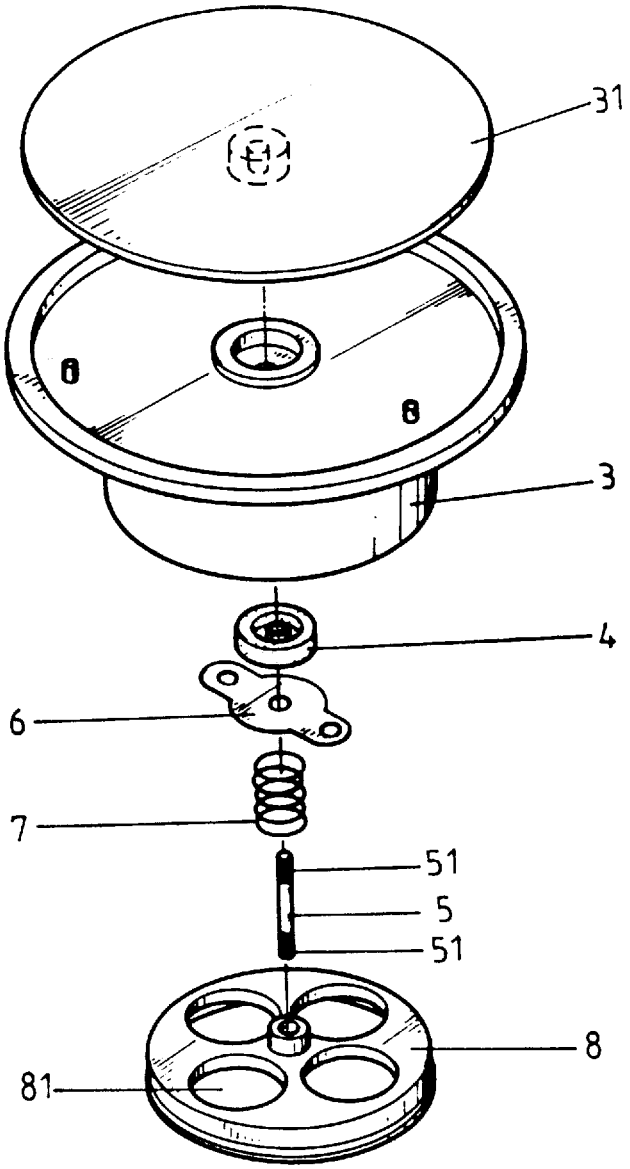
FIG. 2 is a perspective exploded view of the present invention.
Figure 3:
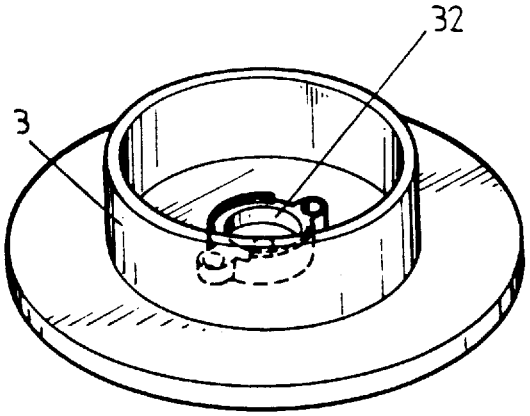
FIG. 3 is a bottom view of the seat member of the driving mechanism of the present invention.
Figure 4:
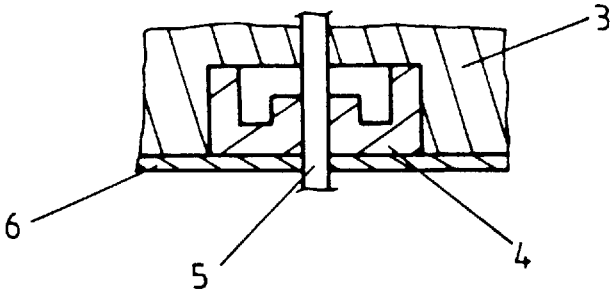
FIG. 4 is a sectional view of the silicone gasket of the present invention, in which the shaft rod is passed through the silicone gasket.

Please refer to FIG. 1. The music water ball 1 of the present invention has internal decoration 11 which can be rotated in accordance with the music. A base 2 is disposed under the water ball 1 for containing a driving mechanism which provides rotational power for the decoration 11. The driving mechanism includes a seat member 3, a silicone gasket 4, a central shaft rod 5, a fastening plate 6, a spring 7 and a driven perforated disc 8. The above components are driven by the conventional winding spring and driving block 10 of the music bell 9. A rotary tray 31 is disposed above the seat member 3 for rotatably placing the decoration 11 thereon. The central shaft rod 5 is fitted with an inner hole seat 32 of the seat member 3 and passed through the base 2 to engage with the rotary tray 31 at the end. The silicone gasket 4 is disposed in the inner hole seat 32 of the seat member 3 as shown in FIG. 3. The silicone gasket 4, as shown in FIG. 2, is formed with inner and outer rings. Referring to FIG. 4, when the gasket 4 is assembled with the inner hole seat 32 with the shaft rod 5 passing therethrough, in the case that the water infiltrates back, the water will accumulate in an annular groove defined by the inner and outer rings to create a fastening pressure for forcing the gasket toward the central shaft rod 5 and binding the same. Therefore, the water is prevented from infiltrating back into the driving mechanism so as to avoid rusting thereof.

In addition, each of upper and lower ends of the shaft rod 5 is formed with engaging teeth 51. The upper end of the shaft rod 5 is engaged with a corresponding structure of the rotary tray 31 and the lower end thereof is engaged with a corresponding structure of the central hole of the driven perforated disc 8. By means of the engagement between the engaging teeth, the transmission of power is accurate without slippage or loss. Also, a coil spring 7 is fitted around the shaft rod 5 to abut against the fastening plate 6 locked on the inner hole seat 32 of the seat member 3. When the music bell 9 drives the shaft rod 5 to rotate, the spring 7 provides a buffering effect. The perforated disc 8 is disposed under the seat member 3 and formed with four symmetrical holes 81 for engaging with corresponding rotary driving blocks 10 as shown in FIG. 1. Accordingly, the driving mechanism can be more smoothly and accurately rotated.

It is to be understood that the above description and drawings are only used for illustrating one embodiment of the present invention, not intended to limit the scope thereof. Any variation and derivation from the above description and drawings should be included in the scope of the present invention.

What is claimed is:

1. A driving mechanism for a musical water ball, comprising:

a base disposed under the water ball to contain said driving mechanism, said driving mechanism comprising a seat member, a silicone gasket, a central shaft rod, a fastening plate, a spring and a driven perforated disc, wherein:

a rotary tray is disposed above said seat member for rotatably placing a decoration thereon, said central shaft rod being received in an inner hole seat of said seat member and passed through said base to engage with said rotary tray, said silicone gasket being disposed in said inner hole seat of said seat member, said silicone gasket being formed with inner and outer rings, whereby when said gasket is assembled with said inner hole seat with said shaft rod passing therethrough, when water seeps back, the water will accumulate in an annular groove defined by said inner and outer rings to create a fastening pressure to force said gasket toward said central shaft rod and binding said central shaft rod; and said spring is fitted around said shaft rod to abut against said fastening plate locked on said inner hole seat of said seat member, whereby when said music ball drives said shaft rod, said spring provides a buffering effect, said perforated disc being disposed under said seat member and formed with four symmetrical holes to engage corresponding rotary driving blocks, so that said driving mechanism can be more smoothly and accurately rotated.

2. A driving mechanism as claimed in claim 1, wherein each of upper and lower ends of said shaft rod is formed with engaging teeth, said upper end of said shaft rod being engaged with a corresponding structure of said rotary tray and said lower end thereof being engaged with a corresponding structure of said central hole of said driven perforated disc.

* * * * *